US010734761B1

(12) United States Patent
Su et al.

(10) Patent No.: US 10,734,761 B1
(45) Date of Patent: Aug. 4, 2020

(54) ANTI-VIBRATION CONNECTOR AND METHOD FOR ASSEMBLING THE SAME

(71) Applicant: NEXTRONICS ENGINEERING CORP., New Taipei (TW)

(72) Inventors: Hou-An Su, Keelung (TW); Yong Zhang, Guangdong (CN)

(73) Assignee: NEXTRONICS ENGINEERING CORP., New Taipei (TW)

( * ) Notice: Subject to any disclaimer, the term of this patent is extended or adjusted under 35 U.S.C. 154(b) by 0 days.

(21) Appl. No.: 16/517,755

(22) Filed: Jul. 22, 2019

(30) Foreign Application Priority Data

Feb. 11, 2019 (CN) ..... 2019 1 0110090

(51) Int. Cl.
*H01R 13/622* (2006.01)
*H01R 13/533* (2006.01)
*H01R 13/639* (2006.01)

(52) U.S. Cl.
CPC ..... *H01R 13/622* (2013.01); *H01R 13/533* (2013.01); *H01R 13/639* (2013.01)

(58) Field of Classification Search
CPC .. H01R 13/625; H01R 13/623; H01R 13/622; H01R 13/639; H01R 13/533
USPC ..... 439/318, 319, 321
See application file for complete search history.

(56) References Cited

U.S. PATENT DOCUMENTS 3,663,926 A * 5/1972 Brandt ..... H01R 13/621 439/321
4,534,607 A * 8/1985 Tomsa ..... H01R 13/641 439/312
5,399,096 A * 3/1995 Quillet ..... H01R 13/622 439/312
5,702,263 A * 12/1997 Baumann ..... H01R 13/622 439/321
6,123,563 A * 9/2000 Johnson ..... H01R 13/622 439/321
7,914,311 B1 * 3/2011 Gallusser ..... H01R 13/639 439/321
8,002,566 B1 * 8/2011 Baumann ..... H01R 13/622 285/82
8,579,644 B2 11/2013 Cole et al.
(Continued)

FOREIGN PATENT DOCUMENTS

TW 296126 U 1/1997

*Primary Examiner* — Gary F Paumen
(74) *Attorney, Agent, or Firm* — Li & Cai Intellectual Property (USA) Office

(57) ABSTRACT

An anti-vibration connector including an insulating body, a plurality of terminals, an inner housing, an outer housing, two ratchet assemblies, an elastic member and a rear housing. The terminals are disposed through the insulating body. The insulating body is disposed in the inner housing. The outer housing is sleeved outside the inner housing. The outer housing and the inner housing form a chamber. The ratchet assemblies are disposed in the chamber. The first ratchets are floatingly disposed on the outer housing, and the second ratchets are floatingly disposed on the inner housing. The elastic member is disposed between the two ratchet assemblies. The elastic member pushes the two second ratchets such that the two second ratchets are engaged with the two first ratchets, respectively. The rear housing is assembled to the inner housing, such that the two ratchet assemblies and the elastic member are positioned in the chamber.

14 Claims, 7 Drawing Sheets

(56) References Cited

U.S. PATENT DOCUMENTS

| | | | | |
|---|---|---|---|---|
| 2015/0162702 | A1* | 6/2015 | Opgenorth ..... | H01R 13/622<br>439/312 |
| 2018/0083384 | A1* | 3/2018 | Burns ..... | H01R 13/622 |

* cited by examiner

ANTI-VIBRATION CONNECTOR AND METHOD FOR ASSEMBLING THE SAME

CROSS-REFERENCE TO RELATED PATENT APPLICATION

This application claims the benefit of priority to China Patent Application No. 201910110090.2, filed on Feb. 11, 2019. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an anti-vibration connector, and more particularly to a threaded anti-vibration connector and a method for assembling the same.

BACKGROUND OF THE DISCLOSURE

Conventional threaded connectors are often used in land or airborne vehicles. Due to prolonged operation in an environment with large vibration, these connectors are prone to looseness, resulting in interruption of signal or current. Some threaded connectors appearing on the market mainly uses a ratchet structure to prevent loosening. However, these threaded connectors have limited anti-loose and anti-vibration effects. For example, due to the ratchet separation caused by inertial motion, the conventional threaded connectors are still not usable in an environment with large vibration.

SUMMARY OF THE DISCLOSURE

In response to the above-referenced technical inadequacies, the present disclosure provides an anti-vibration connector and a method for assembling the same. The anti-vibration connector has the effects of anti-loose and anti-vibration, and can be used in an environment with large vibration.

In one aspect, the present disclosure provides an anti-vibration connector including an insulating body, a plurality of terminals, an inner housing, an outer housing, two ratchet assemblies, an elastic member, and a rear housing. The terminals are disposed through the insulating body. The insulating body is disposed in the inner housing, and the inner housing has a first housing portion. The outer housing is sleeved outside the inner housing. The outer housing has a second housing portion and an internal thread, and the internal thread is disposed on an inner surface of the second housing portion. The outer housing and the inner housing form a chamber therebetween, and the chamber is adjacent to the rear end of the outer housing. The two ratchet assemblies are disposed in the chamber. Each of the ratchet assemblies includes a first ratchet and a second ratchet, the first ratchet has a first annular body and a plurality of first ratchet teeth, and the first ratchet teeth are disposed on the first annular body. The second ratchet has a second annular body and a plurality of second ratchet teeth, and the second ratchet teeth are disposed on the second annular body. The first ratchets of the two ratchet assemblies are floatingly disposed on the outer housing, and the second ratchets of the two ratchet assemblies are floatingly disposed on the inner housing. The elastic member is disposed in the chamber and disposed between the two ratchet assemblies. The elastic member is configured to push the second ratchets of the two ratchet assemblies such that the two second ratchets are engaged with the two first ratchets, respectively. The rear housing is assembled to the inner housing such that the two ratchet assemblies and the elastic member are positioned in the chamber.

In one aspect, the present disclosure provides a method for assembling an anti-vibration connector including: forming an insulating body, a plurality of terminals, an inner housing, an outer housing, two ratchet assemblies, an elastic member and a rear housing; in which the inner housing has a first housing portion, the outer housing has a second housing portion and an internal thread, and the internal thread is disposed on an inner surface of the second housing portion; in which each of the ratchet assemblies includes a first ratchet and a second ratchet, the first ratchet has a first annular body and a plurality of first ratchet teeth, and the first ratchet teeth are disposed on the first annular body; and in which the second ratchet has a second annular body and a plurality of second ratchet teeth, and the second ratchet teeth are disposed on the second annular body. Next, the method further includes: inserting the terminals into the insulating body; disposing the insulating body in the inner housing; and disposing the inner housing in the outer housing, such that the outer housing is sleeved outside the inner housing; in which the outer housing and the inner housing form a chamber therebetween, and the chamber is adjacent to the rear end of the outer housing. Finally, the method further includes: disposing the two ratchet assemblies in the chamber; in which the first ratchets of the two ratchet assemblies are floatingly disposed on the outer housing, the second ratchets of the two ratchet assemblies are floatingly disposed on the inner housing, the elastic member is disposed between the two ratchet assemblies, and the elastic member is configured to push the second ratchets of the two ratchet assemblies, such that the two second ratchets are engaged with the two first ratchets, respectively; and in which the rear housing is configured to be assembled to the inner housing, such that the two ratchet assemblies and the elastic member are positioned in the chamber to form an anti-vibration connector.

Therefore, the anti-vibration connector of the present disclosure includes two ratchet assemblies. Accordingly, when encountering impact or vibration, the anti-vibration connector of the present disclosure can be more reliable than a connector that only includes a single ratchet assembly. Since at least one of the two ratchet assemblies can remain in an engaged state during impact or vibration, the effects of anti-loose and anti-vibration can be improved. Moreover, the first ratchets of the two ratchet assemblies are floatingly disposed on the outer housing, and the second ratchets of the two ratchet assemblies are floatingly disposed on the inner housing, so that the first ratchets and the second ratchets of the two ratchet assemblies are disposed in a floating manner. The anti-vibration connector of the present disclosure is capable of absorbing kinetic energy via the elastic member when encountering impact or vibration. In addition, the two ratchet assemblies respectively disposed at the front end and the rear end are capable of resisting the displacement of the forward and reverse inertial motion, so that the effects of anti-loose and anti-vibration can be improved.

Further, the first ratchet teeth and the second ratchet teeth all have tapered shapes, so that the areas where the first ratchet teeth are engaged to the second ratchet teeth can be increased, respectively, and the effects of anti-loose and anti-vibration can be improved. The anti-vibration connector of the present disclosure can be assembled along only one direction, so that the assembly operation can be simpler and easier.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
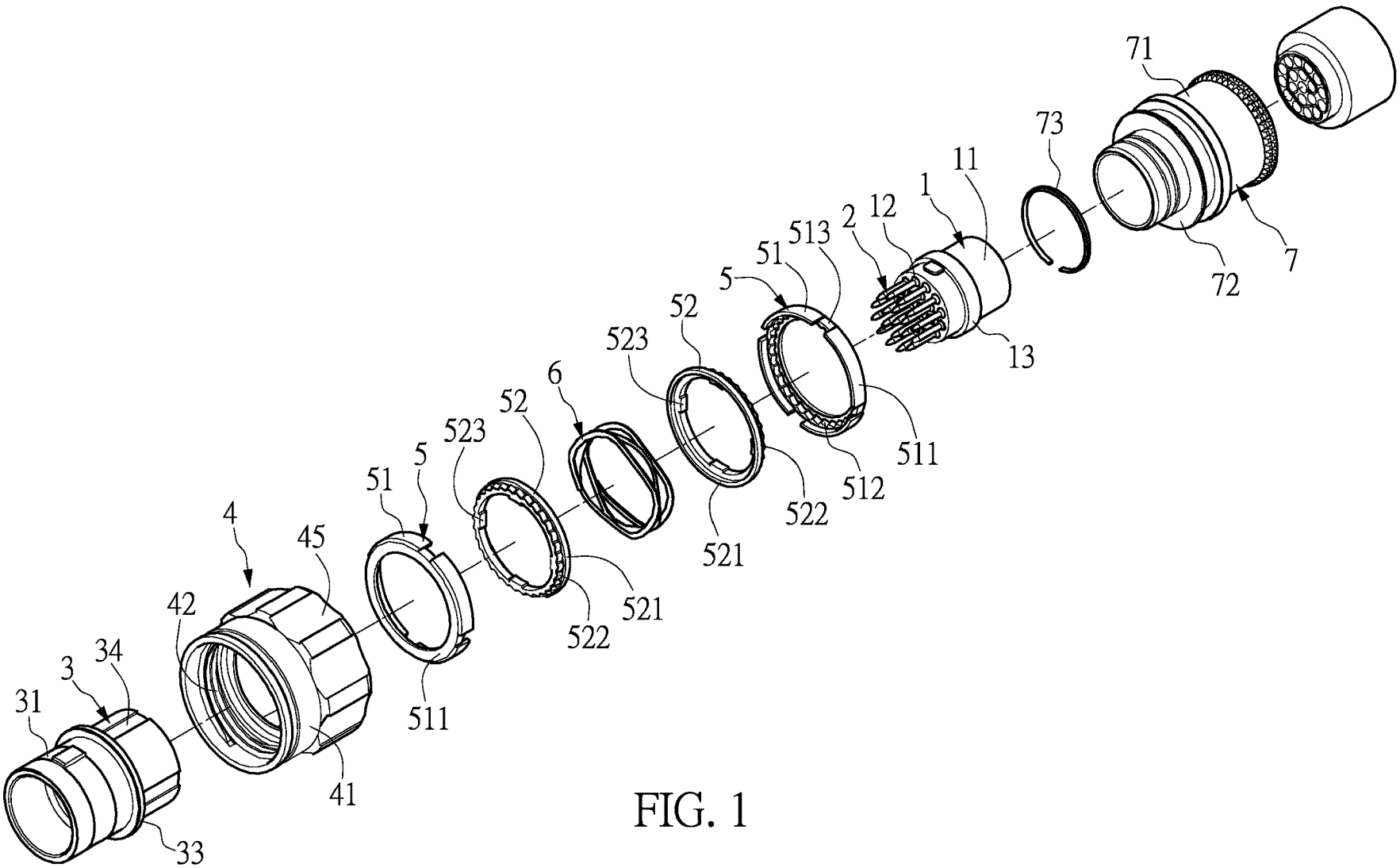
FIG. 1 is an exploded view of an anti-vibration connector according to a first embodiment of the present disclosure.
Figure 2:
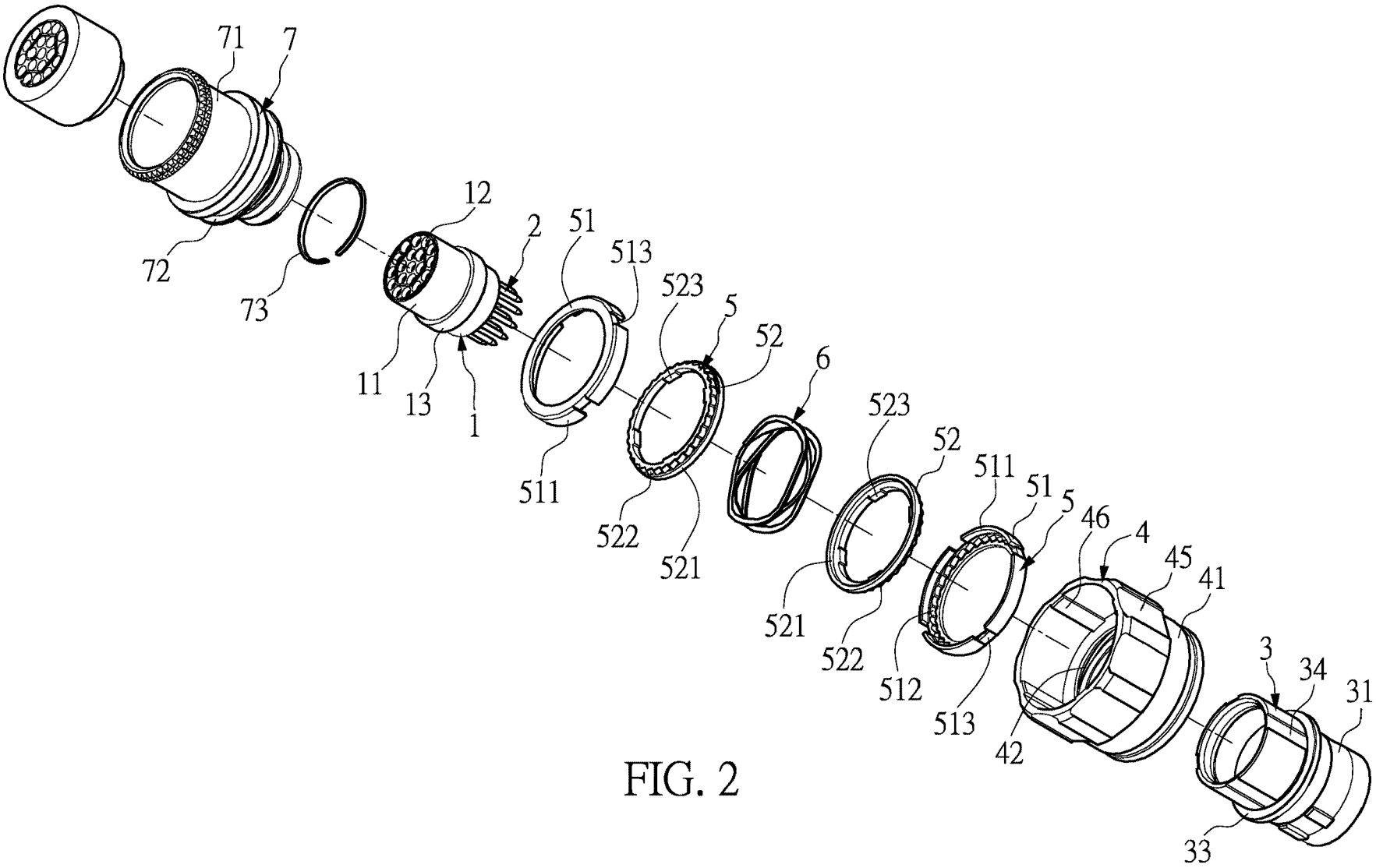
FIG. 2 is another exploded view of the anti-vibration connector according to the first embodiment of the present disclosure.
Figure 3:
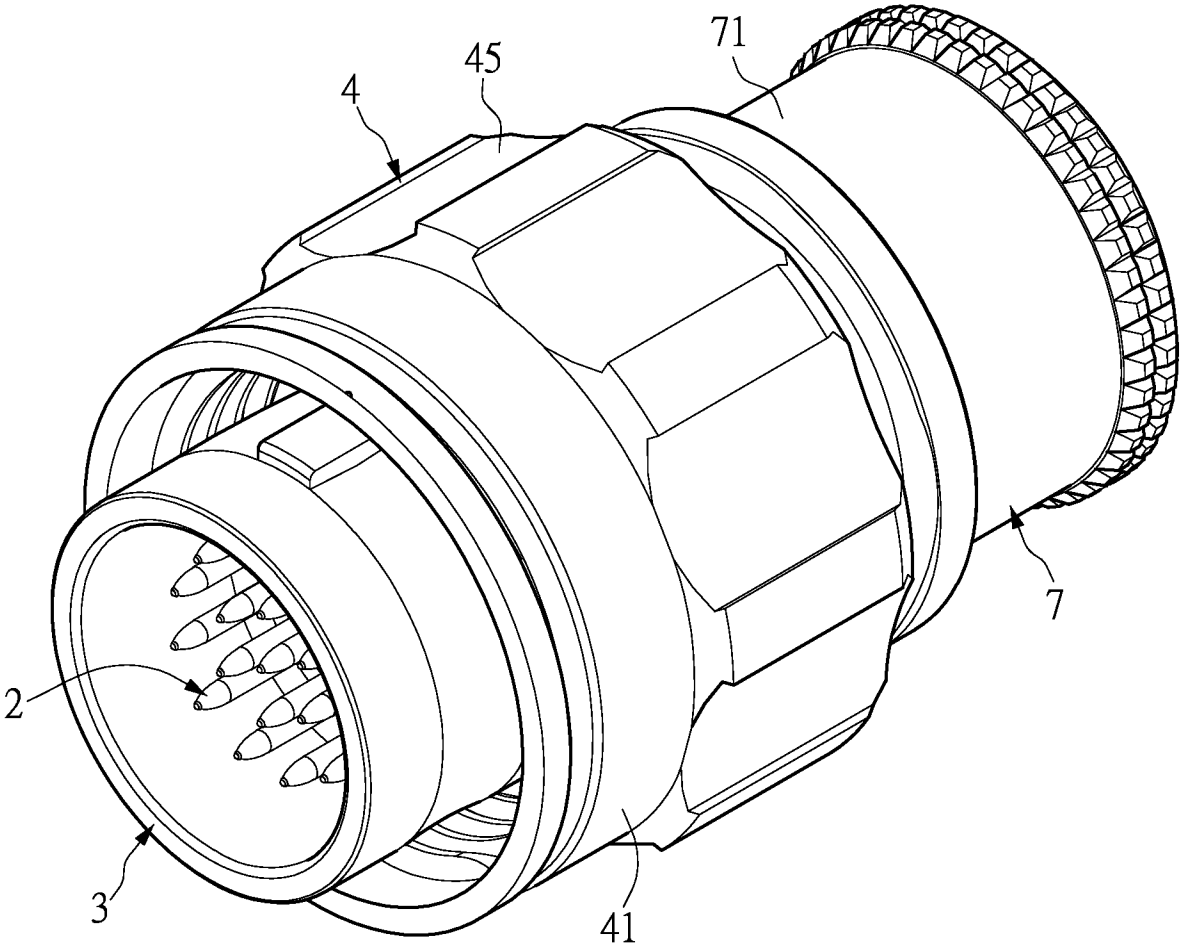
FIG. 3 is a perspective view of the anti-vibration connector according to the first embodiment of the present disclosure.
Figure 4:
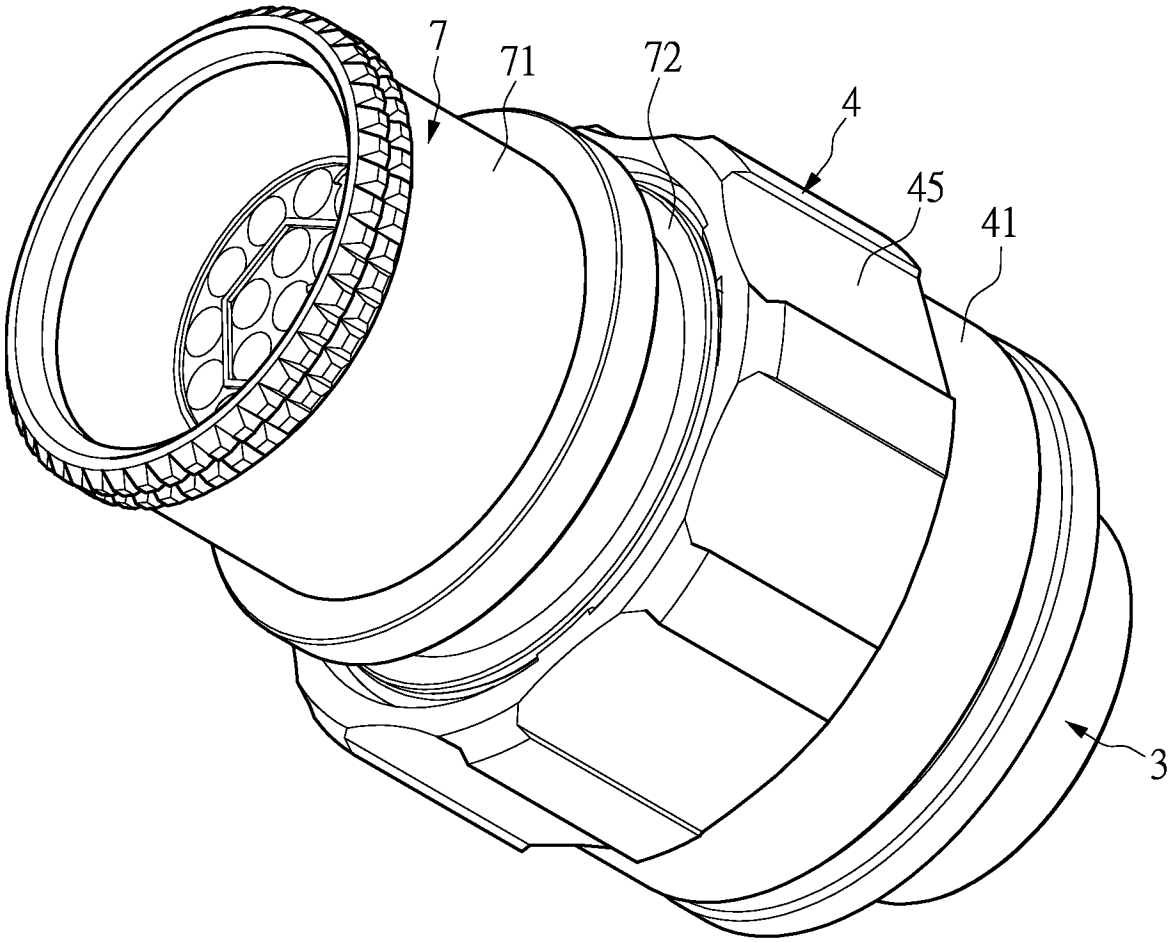
FIG. 4 is another perspective view of the anti-vibration connector according to the first embodiment of the present disclosure.
Figure 5:
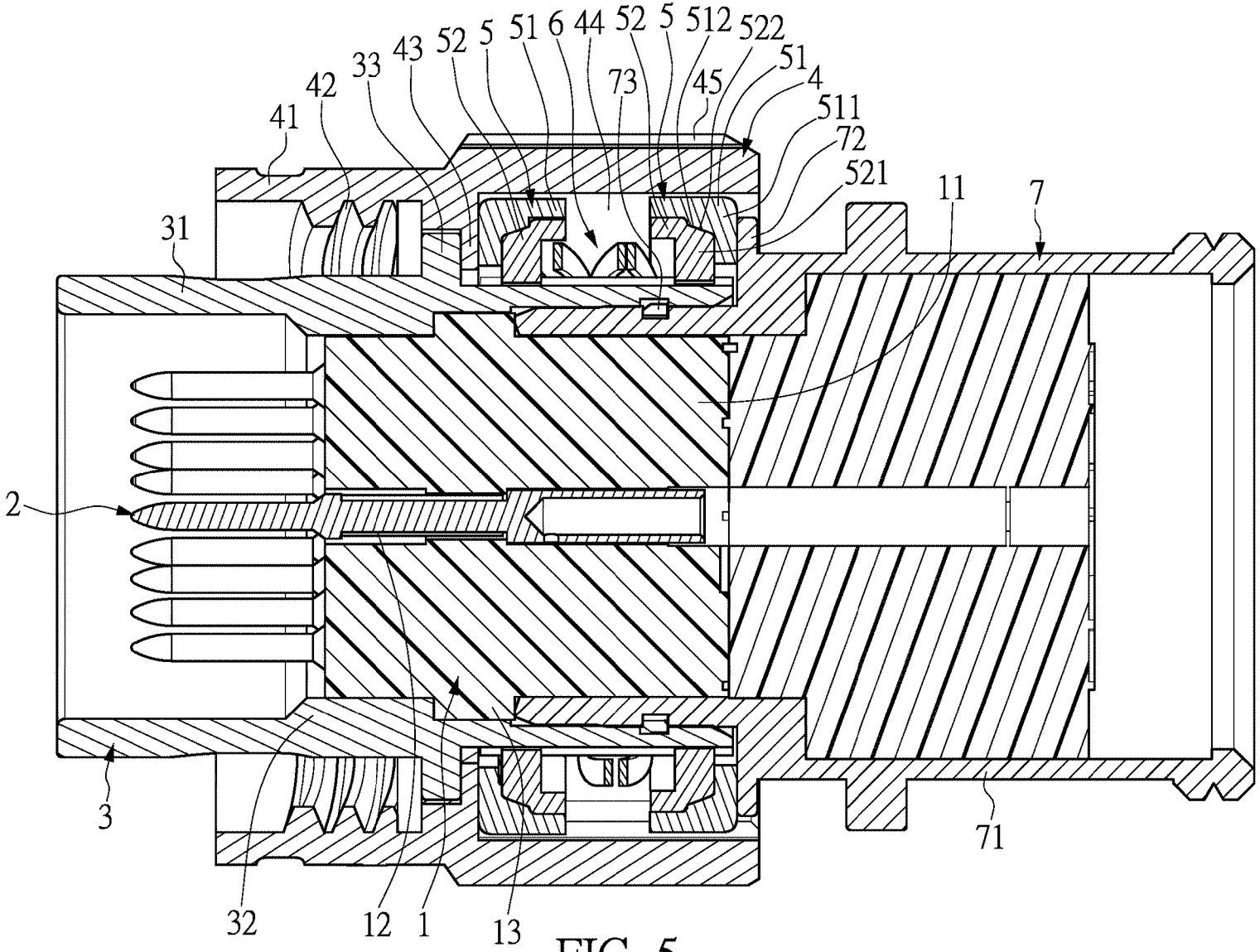
FIG. 5 is a cross-sectional view of the anti-vibration connector according to the first embodiment of the present disclosure.
Figure 6:
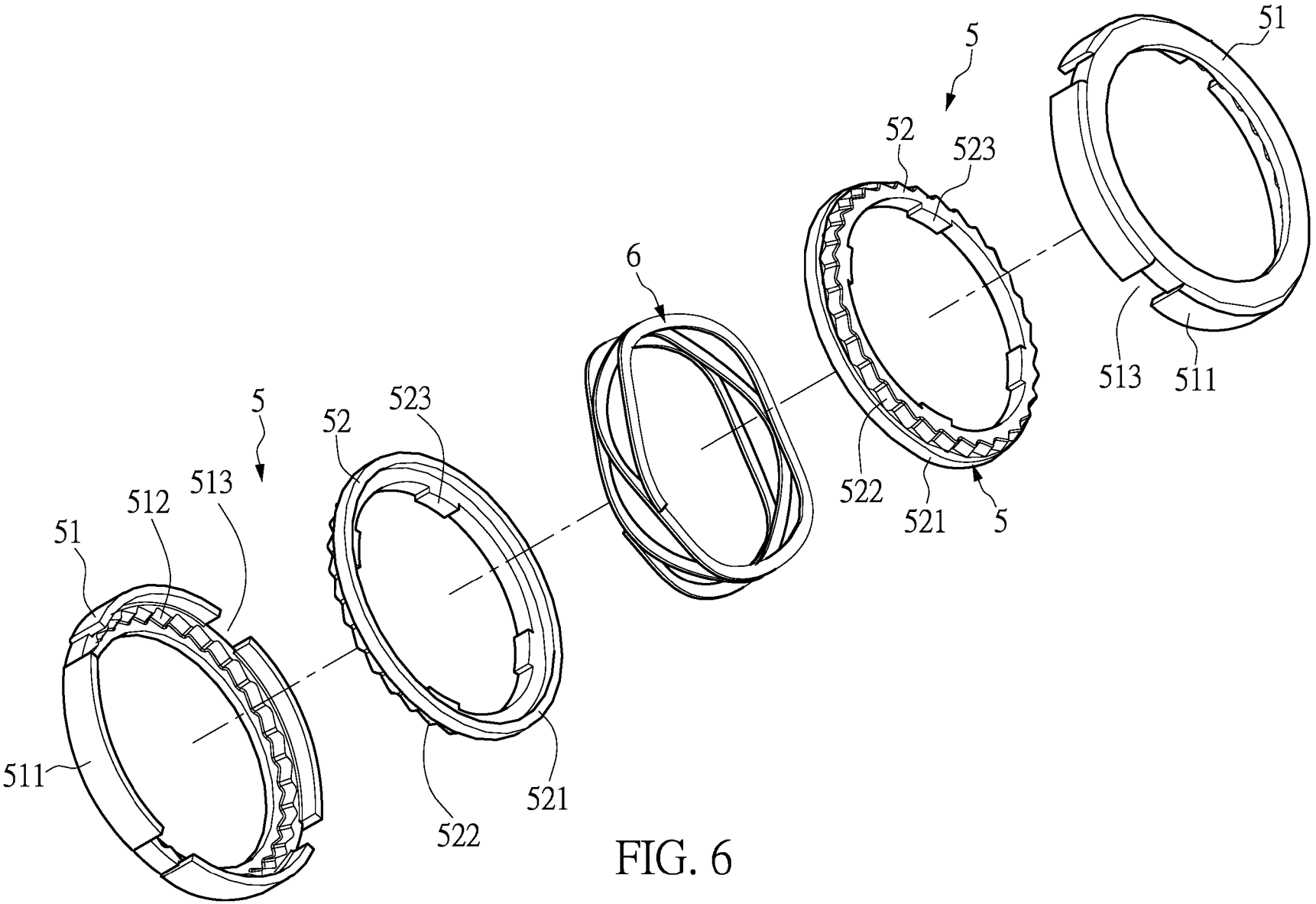
FIG. 6 is an exploded view of two ratchet assemblies and an elastic member according to the first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Referring to FIG. 1 to FIG. 6, a first embodiment of the present disclosure is illustrated. It should be noted that the present embodiment is intended to be illustrative of the present disclosure and is not intended to limit the scope of the present disclosure.

The present embodiment provides an anti-vibration connector, and more particularly, a threaded anti-vibration connector. The connector includes an insulating body 1, a plurality of terminals 2, an inner housing 3, an outer housing 4, two ratchet assemblies 5, an elastic member 6, and a rear housing 7.

The insulating body 1 is made of a plastic material such as PEEK, and the insulating body 1 is an insulator. The insulating body 1 has a main body portion 11 and a plurality of terminal holes 12. The terminal holes 12 are formed through the main body portion 11, correspondingly. More specifically, the terminal holes 12 are formed through a front end and a rear end of the main body portion 11 to facilitate mounting of the terminals 2.

It should be noted that the "front end" of each component recited in the present embodiment means an end close to a mating portion of the connector, and the "rear end" of each component recited in the present embodiment means an end away from the mating portion of the connector. That is, the end of each component that faces a plugging direction is defined as the "front end", and the end of each component that faces away from the plugging direction is defined as the "rear end".

The terminals 2 are made of a metal material having good electrical conductivity. The terminals 2 are disposed through the insulating body 1. The terminals 2 can be used as power terminals or signal terminals. More specifically, the terminals 2 are respectively mounted in the terminal holes 12, such that the terminals 2 are disposed through the insulating body 1, and the front ends of the terminals 2 protrude from the front end of the insulating body 1, which can respectively contact a plurality of terminals of a mating connector to achieve electrical connection.

The inner housing 3 is made of a metal material such as aluminum alloy. The insulating body 1 is disposed in the inner housing 3. The inner housing 3 has a first housing portion 31 and a first annular portion 32, and the first annular portion 32 protrudes from an inner surface of the first housing portion 31. The insulating body 1 further has a second annular portion 13, and the second annular portion 13 protrudes from an outer surface of the main body portion 11. The insulating body 1 is configured to be inserted into the inner housing 3 from the rear end of the inner housing 3, and the second annular portion 13 is configured to abut against the first annular portion 32, such that the insulating body 1 and the terminals 2 are accurately positioned in the inner housing 3.

The outer housing 4 is made of a metal material such as aluminum alloy. The outer housing 4 is sleeved outside the inner housing 3. The outer housing 4 has a second housing portion 41 and an internal thread 42, the internal thread 42 is disposed on (or formed on) an inner surface of the second housing portion 41, and the internal thread 42 is configured to be screwed to a mating connector. The outer housing 4 further has a third annular portion 43, the third annular portion 43 protrudes from the inner surface of the second housing portion 41 and is adjacent to the rear end of the internal thread 42. The inner housing 3 further has a fourth annular portion 33, and the fourth annular portion 33 protrudes from an outer surface of the first housing portion 31. The outer housing 4 is configured to be sleeved outside the inner housing 3 from the rear end of the inner housing 3, and the third annular portion 43 is configured to abut against the fourth annular portion 33, such that the outer housing 4 is positioned outside the inner housing 3. The outer housing 4 is configured to freely rotate outside the inner housing 3, such that the internal thread 42 is configured to be screwed to a mating connector.

The outer housing 4 and the inner housing 3 form a chamber 44 therebetween. The chamber 44 is adjacent to the rear end of the outer housing 4. The outer surface of the second housing portion 41 of the outer housing 4 has a plurality of recess grooves 45 spaced apart from each other. The recess grooves 45 are curved and recessed, respectively. The recess grooves 45 extend from the front end and the rear end of the second housing portion 41, respectively. The recess grooves 45 provide an anti-slip effect to facilitate rotation of the outer housing 4.

The two ratchet assemblies 5 and the elastic member 6 are disposed in the chamber 44. The rear housing 7 is configured to be assembled to the inner housing 3. More specifically, the rear housing 7 is configured to be assembled to the rear end of the inner housing 3. The rear housing 7 has a third housing portion 71 and a block ring 72. The block ring 72 protrudes from an outer surface of the third housing portion 71. The block ring 72 is located at the rear end of the chamber 44. The block ring 72 is configured to block the two ratchet assemblies 5 that are adjacent to each other, such that the two ratchet assemblies 5 and the elastic member 6 are positioned in the chamber 44. The outer surface of the third housing portion 71 can be provided with a C-shaped buckle 73. The C-shaped buckle 73 is configured to buckle between the first housing portion 31 and the third housing portion 71 to prevent detachment of the rear housing 7. The two ratchet assemblies 5 are arranged opposite to each other, that is, the two ratchet assemblies 5 are arranged symmetrically to each other. Each of the ratchet assemblies 5 includes a first ratchet 51 and a second ratchet 52. The first ratchet 51 has a first annular body 511 and a plurality of first ratchet teeth 512, and the first ratchet teeth 512 are disposed on (or formed on) the first annular body 511. The second ratchet 52 has a second annular body 521 and a plurality of second ratchet teeth 522, and the second ratchet teeth 522 are disposed on (or formed on) the second annular body 521. The first ratchet teeth 512 correspond in shape to the second ratchet teeth 522, respectively. The first ratchet teeth 512 and the second ratchet teeth 522 are all mono-directional teeth. The second ratchet teeth 522 are located inside the first ratchet teeth 512, respectively. Preferably, the first ratchet teeth 512 and the second ratchet teeth 522 all have tapered shapes. More specifically, the first ratchet teeth 512 and the second ratchet teeth 522 all have the tapered shapes along the plugging and unplugging direction (axial direction) of the anti-vibration connector. In addition, inner diameters of the first ratchet teeth 512 and outer diameters of the second ratchet teeth 522 gradually increase toward the elastic member 6, such that areas where the first ratchet teeth 512 are engaged to the second ratchet teeth 522 are increased, respectively.

The first ratchets 51 of the two ratchet assemblies 5 are floatingly disposed on the outer housing 4. That is, the first ratchets 51 are movable on the outer housing 4 along the plugging and unplugging direction (axial direction) of the anti-vibration connector. In the present embodiment, the first annular body 511 of each of the first ratchets 51 has a plurality of first guiding grooves 513, and an inner surface of the second housing portion 41 of the outer housing 4 has a plurality of first guiding protrusions 46. The first guiding grooves 513 of the first ratchets 51 are slidably engaged with the first guiding protrusions 46 for guiding the first ratchets 51 to be floatingly disposed on the outer housing 4.

The second ratchets 52 of the two ratchet assemblies 5 are floatingly disposed on the inner housing 3. That is, the second ratchets 52 are movable on the inner housing 3 along the plugging and unplugging direction (axial direction) of the anti-vibration connector. In the present embodiment, the second annular body 521 of each of the second ratchets 52 has a plurality of second guiding protrusions 523, and an outer surface of the first housing portion 31 of the inner housing 3 has a plurality of second guiding grooves 34. The second guiding protrusions 523 are slidably engaged with the second guiding grooves 34 for guiding the second ratchets 52 to be floatingly disposed on the inner housing 3.

The elastic member 6 is disposed between the two ratchet assemblies 5. The elastic member 6 is preferably a wave spring. The elastic member 6 is configured to push the second ratchets 52 of the two ratchet assemblies 5 such that the two second ratchets 52 are engaged with the two first ratchets 51, respectively. That is, each of the second ratchets 52 is engaged with the corresponding first ratchet 51 via the elastic member 6. When the first ratchets 51 and the second ratchets 52 of the two ratchet assemblies 5 are engaged with each other, the outer housing 4 cannot rotate along a detaching direction, but can rotate along a tightening direction, thereby preventing the outer housing 4 from detachment.

Second Embodiment

Figure 7:
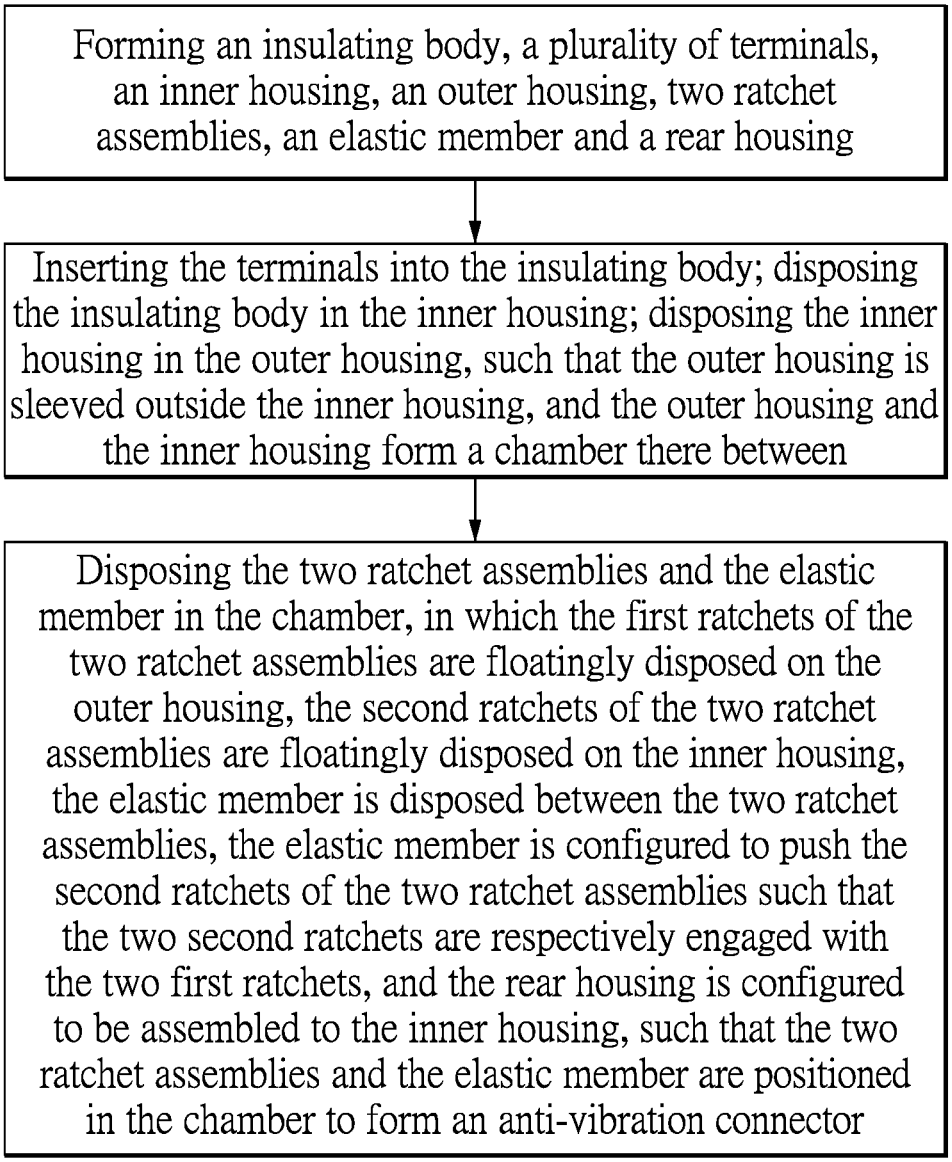
FIG. 7 is a flow chart of a method for assembling an anti-vibration connector according to a second embodiment of the present disclosure.

Referring to FIG. 7, a second embodiment of the present disclosure provides a method for assembling an anti-vibration connector.

Firstly, the method of the present embodiment includes: forming an insulating body 1, a plurality of terminals 2, an inner housing 3, an outer housing 4, two ratchet assemblies 5, an elastic member 6 and a rear housing 7 (as shown in FIG. 1 to FIG. 6). The inner housing 3 has a first housing portion 31. The outer housing 4 has a second housing portion 41 and an internal thread 42, and the internal thread 42 is disposed on (or formed on) an inner surface of the second housing portion 41. Each of the ratchet assemblies 5 includes a first ratchet 51 and a second ratchet 52. The first ratchet 51 has a first annular body 511 and a plurality of first ratchet teeth 512, and the first ratchet teeth 512 are disposed on (or formed on) the first annular body 511. The second ratchet 52 has a second annular body 521 and a plurality of second ratchet teeth 522, and the second ratchet teeth 522 are disposed on (or formed on) the second annular body 521. The structures of the insulating body 1, the terminals 2, the inner housing 3, the outer housing 4, the ratchet assemblies 5, the elastic member 6, and the rear housing 7 are the same as those of the above embodiment, and will not be reiterated herein.

Next, the method of the present embodiment further includes: inserting the terminals 2 into the insulating body 1; disposing the insulating body 1 in the inner housing 3; disposing the inner housing 3 in the outer housing 4 such that the outer housing 4 is sleeved outside the inner housing 3. The outer housing 4 and the inner housing 3 form a chamber 44 therebetween, and the chamber 44 is adjacent to the rear end of the outer housing 4.

Finally, the method of the present embodiment further includes: disposing the two ratchet assemblies 5 and the elastic member 6 in the chamber 44, in which the two ratchet assemblies 5 are arranged opposite to each other, the first ratchets 51 of the two ratchet assemblies 5 are floatingly disposed on the outer housing 4, the second ratchets 52 of the two ratchet assemblies 5 are floatingly disposed on the inner housing 3, the elastic member 6 is disposed between the two ratchet assemblies 5, and the elastic member 6 is configured to push the second ratchets 52 of the two ratchet assemblies 5 such that the two second ratchets 52 are engaged with the two first ratchets 51, respectively. The rear housing 7 is configured to be assembled to the inner housing 3, such that the two ratchet assemblies 5 and the elastic member 6 are positioned in the chamber 44 to form an anti-vibration connector.

In conclusion, the anti-vibration connector of the present disclosure includes two ratchet assemblies. Accordingly, when encountering impact or vibration, the anti-vibration connector of the present disclosure can be more reliable than a connector that only includes a single ratchet assembly. Since at least one of the two ratchet assemblies can remain in an engaged state during impact or vibration, the effects of anti-loose and anti-vibration can be improved. Moreover, the first ratchets of the two ratchet assemblies are floatingly disposed on the outer housing, and the second ratchets of the two ratchet assemblies are floatingly disposed on the inner housing, so that the first ratchets and the second ratchets of the two ratchet assemblies are disposed in a floating manner. The anti-vibration connector of the present disclosure is capable of absorbing kinetic energy via the elastic member when encountering impact or vibration. In addition, the two ratchet assemblies respectively disposed at the front end and the rear end are capable of resisting the displacement of the forward and reverse inertial motion, so that the anti-loose and anti-vibration effects can be improved.

Further, the first ratchet teeth and the second ratchet teeth all have tapered shapes, so that the areas where the first ratchet teeth are engaged to the second ratchet teeth are respectively increased, and the anti-loose and anti-vibration effects of the connector of the present disclosure can be improved. The anti-vibration connector of the present disclosure can be assembled along only one direction, so that the assembly operation can be simpler and easier.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An anti-vibration connector, comprising:

an insulating body;

a plurality of terminals disposed through the insulating body;

an inner housing, the insulating body being disposed in the inner housing; wherein the inner housing has a first housing portion;

an outer housing sleeved outside the inner housing; wherein the outer housing has a second housing portion and an internal thread, the internal thread is disposed on an inner surface of the second housing portion; wherein the outer housing and the inner housing form a chamber therebetween, and the chamber is adjacent to the rear end of the outer housing;

two ratchet assemblies disposed in the chamber; wherein each of the ratchet assemblies includes a first ratchet and a second ratchet, the first ratchet has a first annular body and a plurality of first ratchet teeth, and the first ratchet teeth are disposed on the first annular body; wherein the second ratchet has a second annular body and a plurality of second ratchet teeth, and the second ratchet teeth are disposed on the second annular body; wherein the first ratchets of the two ratchet assemblies are floatingly disposed on the outer housing, and the second ratchets of the two ratchet assemblies are floatingly disposed on the inner housing;

an elastic member disposed in the chamber and disposed between the two ratchet assemblies; wherein the elastic member is configured to push the second ratchets of the two ratchet assemblies such that the two second ratchets are engaged with the two first ratchets, respectively; and a rear housing assembled to the inner housing such that the two ratchet assemblies and the elastic member are fixed in position in the chamber.

2. The anti-vibration connector according to claim 1, wherein the inner housing further has a first annular portion, and the first annular portion protrudes from an inner surface of the first housing portion; wherein the insulating body has a main body portion and a second annular portion, and the second annular portion protrudes from an outer surface of the main body portion; wherein the insulating body is inserted into the inner housing from the rear end of the inner housing, and the second annular portion abuts against the first annular portion to be positioned in place.

3. The anti-vibration connector according to claim 2, wherein the outer housing further has a third annular portion, and the third annular portion protrudes from the inner surface of the second housing portion; wherein the inner housing further has a fourth annular portion, and the fourth annular portion protrudes from an outer surface of the first housing portion; wherein the outer housing is sleeved outside the inner housing from the rear end of the inner housing, and the third annular portion abuts against the fourth annular portion to be positioned in place.

4. The anti-vibration connector according to claim 1, wherein the outer surface of the second housing portion of the outer housing has a plurality of recess grooves spaced apart from each other, the recess grooves are curved and recessed, and the recess grooves extend from the front end and the rear end of the second housing portion, respectively.

5. The anti-vibration connector according to claim 1, wherein the rear housing has a third housing portion and a block ring, the block ring protrudes from an outer surface of the third housing portion, the block ring is located at the rear end of the chamber, and the block ring is configured to block the two ratchet assemblies that are adjacent to each other;

wherein the outer surface of the third housing portion is provided with a C-shaped buckle, and the C-shaped buckle is configured to buckle between the first housing portion and the third housing portion.

6. The anti-vibration connector according to claim 1, wherein the first ratchet teeth and the second ratchet teeth all have tapered shapes along a plugging and unplugging direction of the anti-vibration connector, the second ratchet teeth are located inside the first ratchet teeth, respectively, and inner diameters of the first ratchet teeth and outer diameters of the second ratchet teeth gradually increase toward the elastic member.

7. The anti-vibration connector according to claim 1, wherein the two first ratchets are movable on the outer housing along the plugging and unplugging direction of the anti-vibration connector, and the two second ratchets are movable on the inner housing along the plugging and unplugging direction of the anti-vibration connector.

8. A method for assembling an anti-vibration connector, comprising steps of:

forming an insulating body, a plurality of terminals, an inner housing, an outer housing, two ratchet assemblies, an elastic member and a rear housing; wherein the inner housing has a first housing portion, the outer housing has a second housing portion and an internal thread, and the internal thread is disposed on an inner surface of the second housing portion; wherein each of the ratchet assemblies includes a first ratchet and a second ratchet, the first ratchet has a first annular body and a plurality of first ratchet teeth, and the first ratchet teeth are disposed on the first annular body; wherein the second ratchet has a second annular body and a plurality of second ratchet teeth, and the second ratchet teeth are disposed on the second annular body;

inserting the terminals into the insulating body; disposing the insulating body in the inner housing; and disposing the inner housing in the outer housing, such that the outer housing is sleeved outside the inner housing; wherein the outer housing and the inner housing form a chamber therebetween, and the chamber is adjacent to the rear end of the outer housing; and disposing the two ratchet assemblies in the chamber; wherein the first ratchets of the two ratchet assemblies are floatingly disposed on the outer housing, the second ratchets of the two ratchet assemblies are floatingly disposed on the inner housing, the elastic member is disposed between the two ratchet assemblies, the elastic member is configured to push the second ratchets of the two ratchet assemblies, such that the two second ratchets are engaged with the two first ratchets, respectively; wherein the rear housing is configured to be assembled to the inner housing, such that the two ratchet assemblies and the elastic member are positioned in the chamber to form an anti-vibration connector.

9. The method for assembling the anti-vibration connector according to claim 8, wherein the inner housing further has a first annular portion, and the first annular portion protrudes from an inner surface of the first housing portion; wherein the insulating body has a main body portion and a second annular portion, and the second annular portion protrudes from an outer surface of the main body portion; wherein the insulating body is inserted into the inner housing from the rear end of the inner housing, and the second annular portion abuts against the first annular portion to be positioned.

10. The method for assembling the anti-vibration connector according to claim 9, wherein the outer housing further has a third annular portion, and the third annular portion protrudes from the inner surface of the second housing portion; wherein the inner housing further has a fourth annular portion, and the fourth annular portion protrudes from an outer surface of the first housing portion; wherein the outer housing is sleeved outside the inner housing from the rear end of the inner housing, and the third annular portion abuts against the fourth annular portion to be positioned.

11. The method for assembling the anti-vibration connector according to claim 8, wherein the outer surface of the second housing portion of the outer housing has a plurality of recess grooves spaced apart from each other, the recess grooves are curved and recessed, and the recess grooves extend from the front end and the rear end of the second housing portion, respectively.

12. The method for assembling the anti-vibration connector according to claim 8, wherein the rear housing has a third housing portion and a block ring, the block ring protrudes from an outer surface of the third housing portion, the block ring is located at the rear end of the chamber, and the block ring is configured to block the two ratchet assemblies that are adjacent to each other; wherein the outer surface of the third housing portion is provided with a C-shaped buckle, and the C-shaped buckle is configured to buckle between the first housing portion and the third housing portion.

13. The method for assembling the anti-vibration connector according to claim 8, wherein the first ratchet teeth and the second ratchet teeth all have tapered shapes along a plugging and unplugging direction of the anti-vibration connector, the second ratchet teeth are located inside the first ratchet teeth, respectively, and inner diameters of the first ratchet teeth and outer diameters of the second ratchet teeth gradually increases toward the elastic member.

14. The method for assembling the anti-vibration connector according to claim 8, wherein the two first ratchets are movable on the outer housing along the plugging and unplugging direction of the anti-vibration connector, and the two second ratchets are movable on the inner housing along the plugging and unplugging direction of the anti-vibration connector.

* * * * *